US010233717B2

(12) United States Patent
Hered et al.

(10) Patent No.: US 10,233,717 B2
(45) Date of Patent: Mar. 19, 2019

(54) LOCK TO BALL SEAT FOR NON-METALLIC BALL

(71) Applicant: BAKER HUGHES, A GE COMPANY, LLC, Houston, TX (US)

(72) Inventors: William A. Hered, Houston, TX (US); Steve Rosenblatt, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 79 days.

(21) Appl. No.: 15/341,180

(22) Filed: Nov. 2, 2016

(65) Prior Publication Data

US 2018/0119509 A1 May 3, 2018

(51) Int. Cl.

| | |
|---|---|
| ***E21B 33/12*** | (2006.01) |
| *E21B 23/01* | (2006.01) |
| *E21B 17/10* | (2006.01) |

(52) U.S. Cl.

CPC ..... *E21B 33/12* (2013.01); *E21B 17/1078* (2013.01); *E21B 23/01* (2013.01)

(58) Field of Classification Search

CPC ..... E21B 33/12
USPC ..... 166/386
See application file for complete search history.

(56) References Cited

U.S. PATENT DOCUMENTS

| | | | | |
|---|---|---|---|---|
| 3,796,230 | A * | 3/1974 | Meripol | F16K 15/04 137/533.11 |
| 2011/0061856 | A1* | 3/2011 | Kellner | E21B 23/02 166/193 |
| 2011/0198100 | A1* | 8/2011 | Braekke | E21B 34/14 166/386 |
| 2013/0222148 | A1 | 8/2013 | Gano et al. | |
| 2014/0291031 | A1* | 10/2014 | Lee | E21B 34/14 175/237 |
| 2014/0318816 | A1 | 10/2014 | Hofman et al. | |

* cited by examiner

*Primary Examiner* — Taras P Bemko
(74) *Attorney, Agent, or Firm* — Shawn Hunter

(57) ABSTRACT

A ball seat is provided in a subterranean string for a preferably non-metallic ball. At least one barb is downwardly oriented toward the ball seat and disposed uphole such that as the ball passes the barb, a groove is worn or cut into the outer surface of the ball. When the ball is seated and motion of the ball stops, the end of the barb is at groove bottom of the ball. In that manner, the barb bears against the ball to keep the ball on the seat to prevent fluids from going further downhole as treatment takes place above the ball. The barb can have a variety of shapes that force the ball to be extruded over it to score the outer surface of the ball and keep the ball against the seat. Ultimately, the ball can be blown through the seat with enough pressure applied above it.

18 Claims, 3 Drawing Sheets

LOCK TO BALL SEAT FOR NON-METALLIC BALL

FIELD OF THE INVENTION

The field for the invention is borehole seats that accept a conforming object to allow pressure buildup above and more particularly where the object is retained to the seat after contact by a non-metallic object.

BACKGROUND OF THE INVENTION

Borehole tools are sometimes pressure operated using pressure built up on an object, usually a sphere, which is pumped or dropped to a seat in a desired location. Upon contact with the seat, the pressure can build on the seated ball to activate one or more tools. Frequently, the activated tool is a packer. Other tools that can be reconfigured with pressure on a landed object on a seat can be sliding sleeves, anchors, centralizers, crossovers or bridge plugs to name a few examples. The boreholes where such seats are located are not always in a vertical configuration, so more often than not the ball is pumped until landed on the seat. At that point, the surface pressure jumps as a signal to the rig crew that the ball has landed on the seat.

In some operations, there is a need to keep the ball seated even after a tool was set with pressure on the ball. For example, if acid or a lost circulation material is pumped after the tool is activated with pressure on a seated ball and the ball does not remain seated against the seat, the acid or lost circulation material will go around the ball and further into the hole where equipment can be damaged or destroyed. In a horizontal run, this is particularly problematic because gravity will not aid in keeping the ball on the seat. Some of the treatment materials that need to be stopped by the seated ball are highly viscous formation sealing materials, making ball retaining mechanisms with moving parts problematic as the movement can be precluded by the coating up of the moving parts from the treatment fluid.

Several designs have been offered for retention of generally metallic balls to their respective seat with some axial play or limited axial play. These designs have generally featured movable components subject to getting gummed up by viscous fluids. Others push the ball through an interference fit in the hope it will not only reach its target and seat but then it will stay in position near the seat. This design is shown in US 2013/0222148 FIG. 7 at 408. US 2014/0318816 shows the use of a snap ring or split ring such as 98 in FIG. 3 to retain the ball B close to the seat 100 with an enlarged view shown in FIG. 4. In these figures, the ball can still move axially away from its seat but in FIG. 12 the snap ring 216 is located in close proximity of the ball B so that after the ball spreads ring 216 to get past it, the ring 216 snaps closed with the hope that the ball stays against the seat.

Combining the need to keep a ball against a seat and an application where there is a viscous material that prevents the reliable use of intricate moving parts presents unique design challenges. However, since applications using such materials also involve the use of non-metallic balls, a workable solution has been developed to address the problem of reliably retaining the ball to the seat which forms a part of the present invention. The seat assembly is provided with at least one downhole oriented barb akin to an upside down hook mounted in the wall uphole of the ball seat. As the ball passes, it is forced past the barb, placing an axial notch in the ball that continues to get longer until the ball finds its seat. At that time the bottom of the barb defines the lower end of the axial groove formed in the ball from forcing it past the barb. Any tendency of the ball to move away from the seat brings the bottom of the groove made in the ball against the barb and all motion stops. These and other aspect of the present invention will be more readily apparent to those skilled in the art form a review of the detailed description of the preferred embodiment and the associated drawings while recognizing that the full scope of the invention is to be determined from the appended claims.

SUMMARY OF THE INVENTION

A ball seat is provided in a subterranean string for a preferably non-metallic ball. At least one barb is downwardly oriented toward the ball seat and disposed uphole such that as the ball passes the barb, a groove is worn or cut into the outer surface of the ball. When the ball is seated and motion of the ball stops, the end of the barb is at groove bottom of the ball. In that manner, the barb bears against the ball to keep the ball on the seat to prevent fluids from going further downhole as treatment takes place above the ball. The barb can have a variety of shapes that force the ball to be extruded over it to score the outer surface of the ball and then to keep the ball against the seat. Ultimately, the ball can be blown through the seat with enough pressure applied above it.

In a described embodiment, the at least one barb features a taper having a blunt or wider portion further uphole for initial contact with a ball and tapering to a narrower portion in the downhole direction. In a further embodiment, the at least one barb is capable of extending and retracting toward the ball and may be held retracted with a force actuated latch. In another described embodiment, the at least one barb releases a material to contact the ball to help retain the ball to the seat. The material can be an adhesive or one that hardens or solidifies to enhance grip.

DETAILED DESCRIPTION OF THE PREFERRED EMBODIMENT

Figure 1:
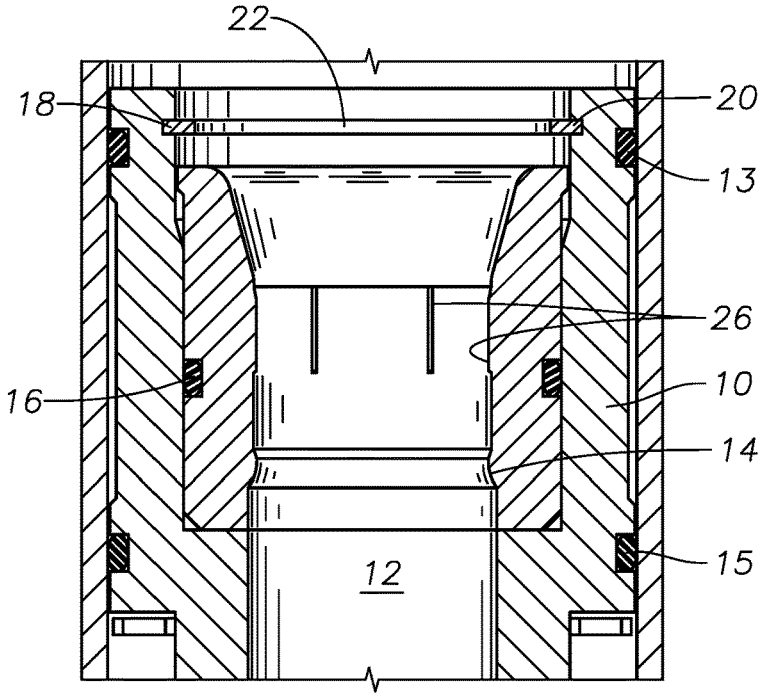
FIG. 1 is a section view of a ball seat before the ball lands on it showing the barb above the ball.
Figure 2:
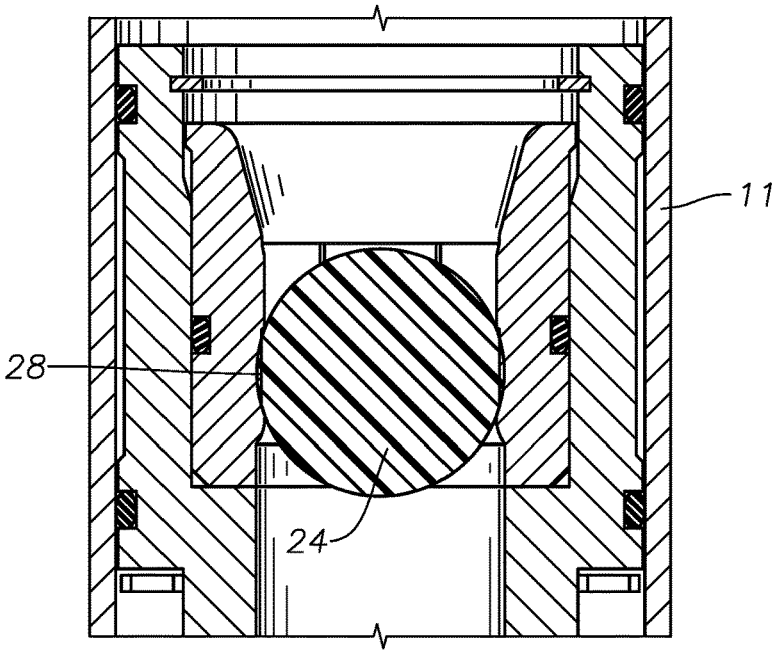
FIG. 2 is the view of FIG. 1 with the ball landed on the seat and having been scored by the barb.

FIG. 1 shows a housing 10 with a through passage 12 in which is disposed a ball seat 14 having a peripheral seal 16 against the housing 10. Housing 10 is sealed at seals 13 and 15 to the tubular string 11. A snap ring 18 is disposed in a groove 20 in passage 12 above the seat 14. Snap ring 18 has an opening 22 through which ball 24 can pass. One or more barbs 26, two of which are shown at 180 degree spacing although different numbers and spacing can be used, each create a score 28 in the preferably non-metallic ball 24 so that after seating the ball 24 on seat 14, the ball 24 will stay close or against the seat 14 and axial movement will be limited as the barb engages the score 28 to hold the ball 24 in position. The ball can be made of a plastic, composite material, or any other soft material that can be scored including some soft metals. It can also be made from a scorable material that can disintegrate using well conditions that exist or are created. Other means for removing the ball from the seat can involve using heat or chemical reaction to aid in the selective structural collapse for removal of the ball. Although a ball is an acceptable shape, other shapes can be used if they interact with the seat to allow pressure buildup with limited leakage.

Figure 4:
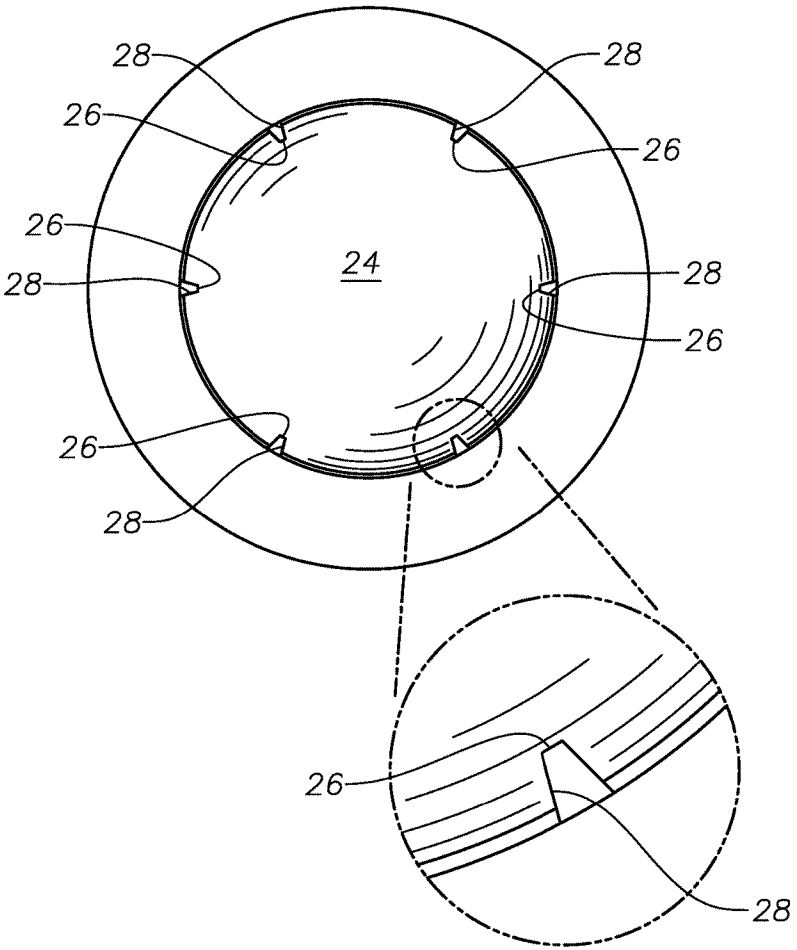
FIG. 4 is a plan view of the ball landed upon the ball seat.
Figure 3:
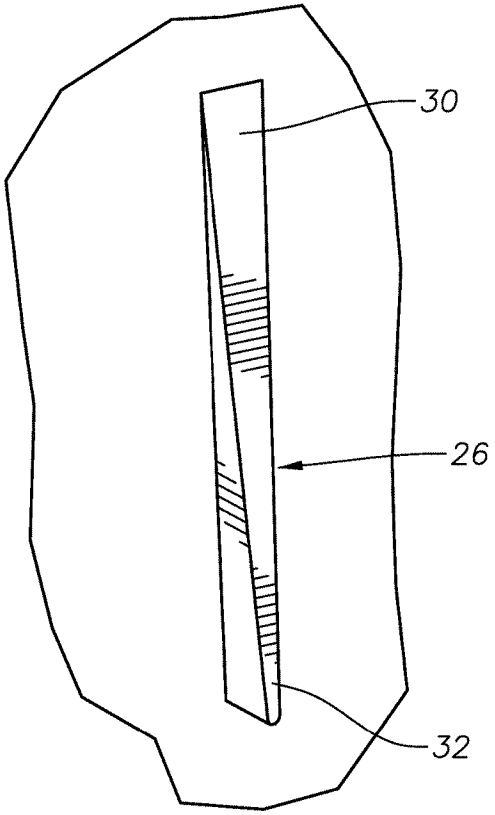
FIG. 3 is a detail view of an exemplary tapered barb in accordance with the present invention.
Figure 6:
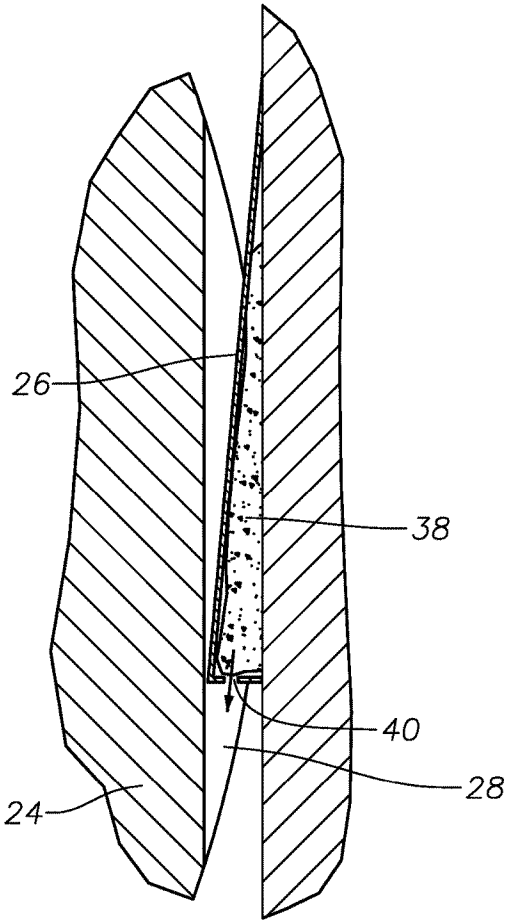
FIG. 6 is a detail view of an exemplary barb which releases material.
Figure 5:
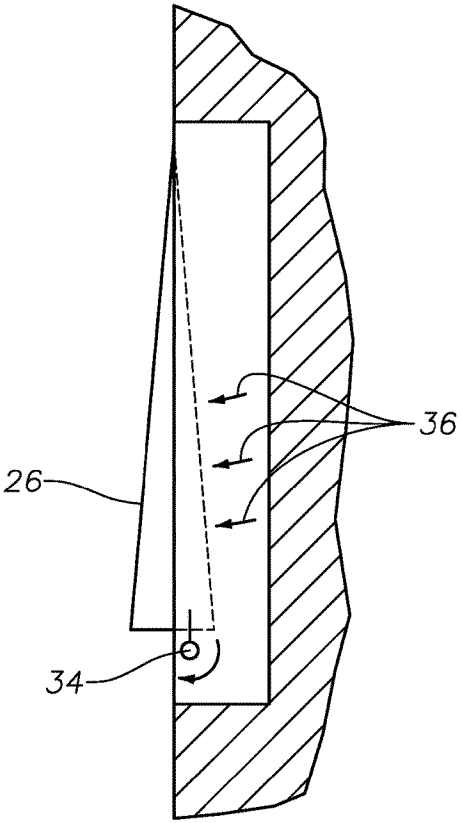
FIG. 5 is a detail view of an exemplary barb which can be extended and retracted.

The illustrated design has applicability where the ball 24 is soft so that a score 28 can form as the ball 24 is forced past the barbs 26. Since the score 28 by definition starts below the largest dimension of ball 24, in the position of the ball seated on seat 14, the score 28 will by necessity intersect the plane of the seat 14. This can mean some leakage when there is pressure applied on the seated ball 24 initially to set a tool such as a packer and then later when there is a viscous loss control material pumped. On the other hand, the seat 14 can be configured with a sufficiently small conforming shape to ball 24 that assuming minimal ball rotation before landing on sat 14, there will be no leakage flow through the scores 28. However, the duration of the pumping of an acidic material or a loss control material is of a short duration and the passage of a minimal amount of fluid past the ball 24 is not critical. Having a retaining device that has moving parts is not desirable because the movement of the parts will become impaired with viscous material. So in horizontal runs where gravity is no help or may even work to push the ball from the seat 14 after a tool is initially activated, the use of a barb or barbs 26 retains the ball on or close to the seat 14 with not moving parts at play. The barb or barbs 26 can be a hook shape or merely a taper (see FIG. 3) with the blunt or wider portion 30 further uphole for initial contact with the ball and tapering to a narrower portion 32 going in a downhole direction. The frictional resistance of the score 28 against the barb 26 should, without meaningful pressure from a downhole direction, be enough resistance to keep the ball 24 on the seat 14 (see FIG. 4). The barbs 26 can have one or more downwardly oriented ridges oriented to get a bite on the ball if it tries to move away from 14 in an uphole direction but more easily let the ball 24 move in an opposite direction toward seat 14. While the barbs can all be in one plane, having them axially offset is an alternative arrangement. Another alternative for the barbs 26 is to have them hook shaped and looking up with a narrower tapered end being what starts the score 28 in ball 24 and the more blunt end on the downhole side being what starts the score 28 in ball 24 and the more blunt end on the downhole side being what holds the ball 24 against the seat 14. As another alternative (see FIG. 5) a barb 26 can have biased extending elements held retracted with a force actuated latch 34 until the force of the ball 24 being pushed past releases a latch 34 to allow potential energy 36 to push out anchor segments laterally for the grip into the ball 24 to hold it to seat 14. Another option is to use the force of the ball on the barb to release a material 38 via opening 40 from the barb to contact the ball to help retain the ball to the seat (see FIG. 6). The material can be an adhesive or one that hardens or solidifies in well conditions to enhance the grip of the ball by the barb 26.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers, etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A tubular string passage isolation apparatus, comprising:

a housing having an uphole end and a downhole end and a flowpath therethrough;

a seat surrounding said flowpath sized to stop travel of an object in a direction toward said downhole end of said housing;

at least one downhole oriented barb extending less than completely around said flowpath, the barb being located uphole from said seat and extending into said flowpath to create at least one score in said object as said object advances toward said seat;

said barb retaining said object on said seat and against uphole movement away from said seat.

2. The apparatus of claim 1, wherein:

said at least one barb remains in said score with said object on said seat to provide a force on said object to keep said object on or close to said seat.

3. The apparatus of claim 1, wherein:

said at least one barb comprises a plurality of barbs disposed in at least one plane.

4. The apparatus of claim 1, wherein:

said at least one barb has a hook shape with an end pointing to said downhole end of said housing.

5. The apparatus of claim 1, wherein:

said barb comprises a taper in an axial direction between said uphole and said downhole ends of said housing.

6. The apparatus of claim 5, wherein:

said taper comprising a thin end oriented toward said downhole end of said housing.

7. The apparatus of claim 1, wherein:

said barb is initially retracted and subsequently extends into said flowpath as a result of said object passing said barb.

8. The apparatus of claim 1, wherein:

said barb releasing a material into said score as said object passes said barb on the way toward said seat by virtue of applying a force to said barb to force said material stored in said barb out a barb opening.

9. The apparatus of claim 8, wherein:

said material comprises at least one of an adhesive, a hardening material and a solidifying material.

10. The apparatus of claim 1, wherein:

said object comprises a non-metallic ball.

11. The apparatus of claim 10, wherein:

said ball is selectively deformable to pass through said seat with applied pressure thereon in a direction from said uphole end to said downhole end of said housing.

12. The apparatus of claim 1, wherein:

a retainer is mounted to the tubing string passage to hold said housing against axial movement.

13. The apparatus of claim 12, wherein:

said retainer having an opening therethrough that is larger than said object.

14. The apparatus of claim 1, wherein:

said object is removed from said seat by disintegration or structural failure.

15. The apparatus of claim 1, wherein:

said object is retained adjacent said seat by a frictional force of said barb adjacent opposed walls that define said score.

16. The apparatus of claim 1, wherein:

said housing comprises at least a portion of a packer, sliding sleeve, anchor, centralizer, crossover or bridge plug.

17. A treating method, comprising:

providing a housing having an uphole end and a downhole end and a flowpath therethrough;

providing a seat surrounding said flowpath sized to stop travel of an object in a direction toward said downhole end of said housing;

locating at least one downhole oriented barb extending less than completely around said flowpath, the barb being located uphole from said seat and extending into said flowpath to create at least one score in said object as said object advances toward said seat;

retaining said object to said seat and against uphole movement away from said seat with said barb;

performing a treatment against said object on said seat.

18. The method of claim 17, further comprising:

pumping a viscous sealant against said object when said object is against said seat.

* * * * *